US008381526B2

(12) United States Patent
Berry et al.

(10) Patent No.: US 8,381,526 B2
(45) Date of Patent: Feb. 26, 2013

(54) SYSTEMS AND METHODS OF PROVIDING HIGH PRESSURE AIR TO A HEAD END OF A COMBUSTOR

(75) Inventors: Jonathan Dwight Berry, Simpsonville, SC (US); Constantin Dinu, Katy, TX (US); Carl Robert Barker, Simpsonville, SC (US); Krishna Kumar Venkataraman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 634 days.

(21) Appl. No.: 12/705,737

(22) Filed: Feb. 15, 2010

(65) Prior Publication Data

US 2011/0197586 A1 Aug. 18, 2011

(51) Int. Cl.
*F02C 3/14* (2006.01)

(52) U.S. Cl. ..... 60/752; 60/746; 60/747; 60/804; 60/760; 60/740

(58) Field of Classification Search ..... 60/722, 60/752, 754, 755, 756, 758, 760, 740, 739, 60/746, 747, 804
See application file for complete search history.

(56) References Cited

U.S. PATENT DOCUMENTS

| | | | | |
|---|---|---|---|---|
| 2,608,057 | A | 8/1952 | Boyd et al. | |
| 2,676,460 | A | 4/1954 | Brown | |
| 2,729,938 | A | 1/1956 | McDowall et al. | |
| 2,801,520 | A | 8/1957 | Highberg | |
| 2,813,397 | A | 11/1957 | Fisher et al. | |
| 3,075,362 | A | 11/1958 | Shutts | |
| 3,086,363 | A | 4/1963 | Fiori | |
| 3,169,367 | A * | 2/1965 | Hussey | 60/39.37 |
| 3,991,562 | A | 11/1976 | Nelson et al. | |
| 4,100,733 | A | 7/1978 | Striebel et al. | |
| 4,151,713 | A | 5/1979 | Faitani et al. | |
| 4,180,974 | A | 1/1980 | Stenger et al. | |
| 4,199,936 | A | 4/1980 | Cowan et al. | |
| 4,292,801 | A | 10/1981 | Wilkes et al. | |
| 4,365,477 | A | 12/1982 | Pearce | |
| 4,573,315 | A | 3/1986 | Stroem | |
| 4,695,247 | A | 9/1987 | Enzaki et al. | |
| 4,843,825 | A | 7/1989 | Clark | |
| 5,012,645 | A | 5/1991 | Reynolds | |
| 5,117,637 | A | 6/1992 | Howell et al. | |
| 5,127,221 | A | 7/1992 | Beebe | |
| 5,129,231 | A | 7/1992 | Becker et al. | |
| 5,235,478 | A | 8/1993 | Hoshimi et al. | |
| 5,253,471 | A | 10/1993 | Richardson | |
| 5,259,184 | A | 11/1993 | Borkowicz et al. | |
| 5,274,991 | A | 1/1994 | Fitts | |
| 5,329,772 | A | 7/1994 | Fitts et al. | |
| 5,357,745 | A | 10/1994 | Probert | |
| 5,415,000 | A | 5/1995 | Mumford et al. | |
| 5,423,368 | A | 6/1995 | Fitts et al. | |
| 6,427,446 | B1 | 8/2002 | Kraft et al. | |
| 6,672,073 | B2 | 1/2004 | Wiebe | |
| 6,711,889 | B2 * | 3/2004 | Kuo et al. | 60/39.511 |
| 6,732,528 | B2 | 5/2004 | Akagi et al. | |

(Continued)

*Primary Examiner* — William H Rodriguez
*Assistant Examiner* — Steven Sutherland
(74) *Attorney, Agent, or Firm* — Sutherland Asbill & Brennan LLP

(57) ABSTRACT

A combustor includes a first flow path and a second flow path. The first flow path places a diffuser in indirect fluid communication with a combustor cap assembly by way of an intervening lower combustor annular passageway. The second flow path places the diffuser in direct fluid communication with the combustor cap assembly.

19 Claims, 5 Drawing Sheets

U.S. PATENT DOCUMENTS 6,910,336 B2 6/2005 Sullivan et al.
6,923,002 B2 8/2005 Crawley et al.
6,983,600 B1 * 1/2006 Dinu et al. ..... 60/737
2007/0125093 A1 * 6/2007 Burd et al. ..... 60/804

* cited by examiner

SYSTEMS AND METHODS OF PROVIDING HIGH PRESSURE AIR TO A HEAD END OF A COMBUSTOR

TECHNICAL FIELD

The present disclosure generally relates to systems and methods of providing high pressure air to a head end of a combustor, and more particularly to systems and methods of cooling a combustor cap assembly.

BACKGROUND OF THE INVENTION

Gas turbines often include a compressor, a number of combustors, and a turbine. Typically, the compressor and the turbine are aligned along a common axis, and the combustors are positioned between the compressor and the turbine in a circular array about the common axis. In operation, the compressor creates compressed air, which is supplied to the combustors. The combustors combust the compressed air with fuel to generate hot combustion products, which are supplied to the turbine. The turbine extracts energy from the hot combustion products to drive a load.

To increase efficiency, modern combustors are operated at temperatures that are high enough to impair the combustor structure and to generate pollutants such as nitrous oxides (NOx). These risks are mitigated by directing the compressed air over the combustor exterior, which cools the combustor, before premixing the air with fuel to form an air-fuel mixture, which generates lower levels of NOx when combusted.

For these reasons, the combustor typically includes a flow sleeve that defines an annular passageway about the combustor. The annular passageway receives air from the compressor through a diffuser positioned adjacent to the combustor. The air impinges against the transition duct and combustion liner for cooling purposes. The air then travels in a reverse direction through the annular passageway toward the combustion cap assembly, which houses the fuel nozzles. A portion of the air is also diverted from the annular passageway to cool the cap assembly.

For example, an end face of the cap assembly is exposed to high temperatures of the combustion chamber. Thus, the end face is normally cooled with air diverted from the annular passageway through openings in the cap assembly wall. The diverted air impinges against and passes through the end face into the combustion chamber. Thus, the diverted air is not pre-mixed with fuel, which exacerbates NOx generation.

The air traveling through the annular passageway experiences pressure loses. Due to these pressure losses, an increased amount of air is needed to cool the cap assembly, resulting in a lower percentage of premixed air in the combustor. Also, the air flow pressure through the end face may not be sufficient to overcome a dynamic pressure wave that is present in the combustion chamber due to flame instability. The dynamic pressure wave may exert a pressure on the end face that impedes or stops the cooling flow, causing the end face to heat and potentially fail.

Supplying higher pressure air to the cap assembly would reduce the amount of air needed for cooling, so that a relatively larger percentage of the combustion air could be premixed with the fuel, reducing NOx generation. Further, supplying higher pressure air would improve the dynamics barrier. Thus, a need exists for supplying higher pressure air to the head end of the combustor, such as to the cap assembly.

BRIEF DESCRIPTION OF THE INVENTION

A combustor includes a first flow path and a second flow path. The first flow path places a diffuser in indirect fluid communication with a combustor cap assembly by way of an intervening lower combustor annular passageway. The second flow path places the diffuser in direct fluid communication with the combustor cap assembly.

Other systems, devices, methods, features, and advantages will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Figure 1:
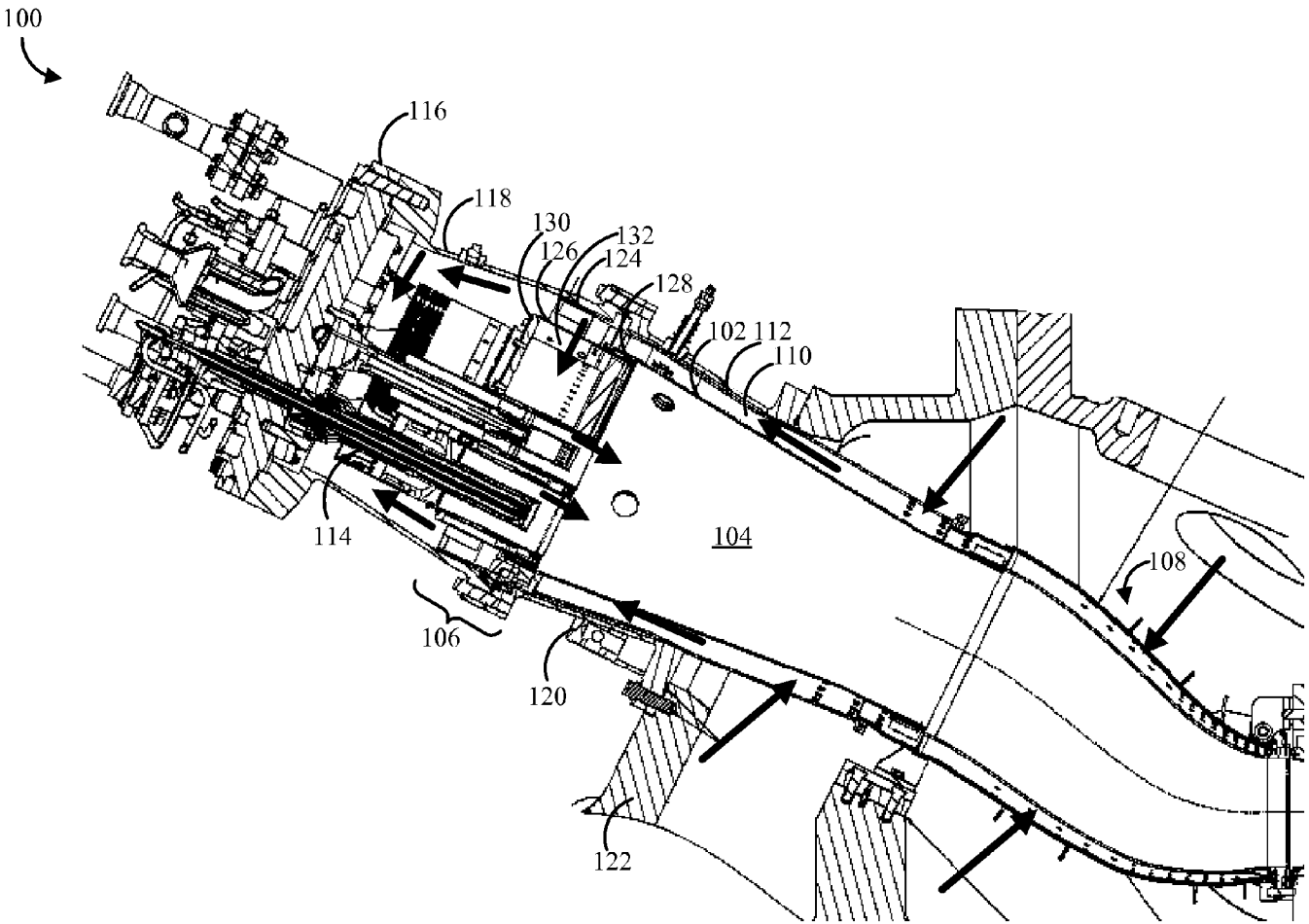
FIG. 1 (PRIOR ART)
FIG. 1 is a cross-sectional view of an embodiment of a prior art combustor, illustrating an air flow path through the combustor.

FIG. 1 is a cross-sectional view of an embodiment of a prior art combustor 100. The combustor 100 includes a combustion liner 102 that defines a combustion chamber 104. The combustion liner 102 extends between a combustion liner cap assembly 106 and a transition duct 108. The combustion liner cap assembly 106 houses fuel nozzles, which premix air and fuel and direct the resulting air-fuel mixture into the combustion chamber 104. The transition duct 108 directs combustion products out of the combustion chamber 104 into an adjacent turbine.

An annular flow sleeve 112 is positioned about the combustor 100. The annular flow sleeve 112 defines an annular passageway 110 or flow path for air to travel from the transition duct 108 toward the cap assembly 106. The annular passageway 110 receives air from the compressor through a diffuser positioned adjacent to the combustor 100. The air may have a relatively high pressure, such as a pressure of compressor discharge (PCD) of about 250 to about 300 psia. Such air is commonly referred to as compressor discharge air or PCD air. The PCD air passes into the combustor 100 through an impingement sleeve, which impinges the air against the transition duct 108 and combustion liner 102. The air then travels in a reverse direction along the length of the combustion chamber 104. Thus, the air cools the combustor 100 before reaching the cap assembly 106. This flow path through the annular passageway 110 is illustrated in FIG. 1 with arrows. The PCD air experiences a pressure drop as it travels along the combustor 100, generally referred to as the combustor pressure drop or "delta P." The delta P may be relatively high, such as about 15 psid.

At the cap assembly 106, the air is premixed with fuel to form an air-fuel mixture. Particularly, a number of fuel nozzles 114 extend from an end cover 116 into the cap assembly 106. The fuel nozzles 114 receive fuel through the end cover 116 and receive air from the annular passageway 110. The fuel nozzles 114 mix the air and fuel and inject the resulting air-fuel mixture into the combustion chamber 104, where the mixture is combusted.

The combustor 100 further includes a forward case 118, an aft case 120, and a compressor discharge case 122. The forward case 118 is positioned at a forward end of the combustor 100 and supports the end cover 116. The aft case 120 is mounted to the compressor discharge case 122, which houses the diffuser. The forward and aft cases 118, 120 jointly form a pressure vessel about an exterior of the combustor, and the cap assembly 106 is positioned inward of the pressure vessel.

Figure 3:
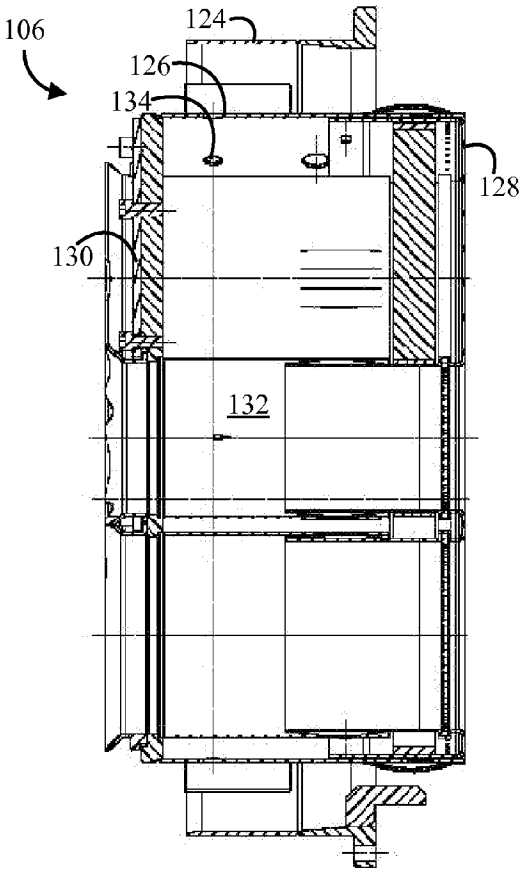
FIG. 3 (PRIOR ART)
FIG. 3 is a partial cross-sectional view of the prior art combustor cap assembly shown in FIG. 2, taken along line 3-3.
Figure 2:
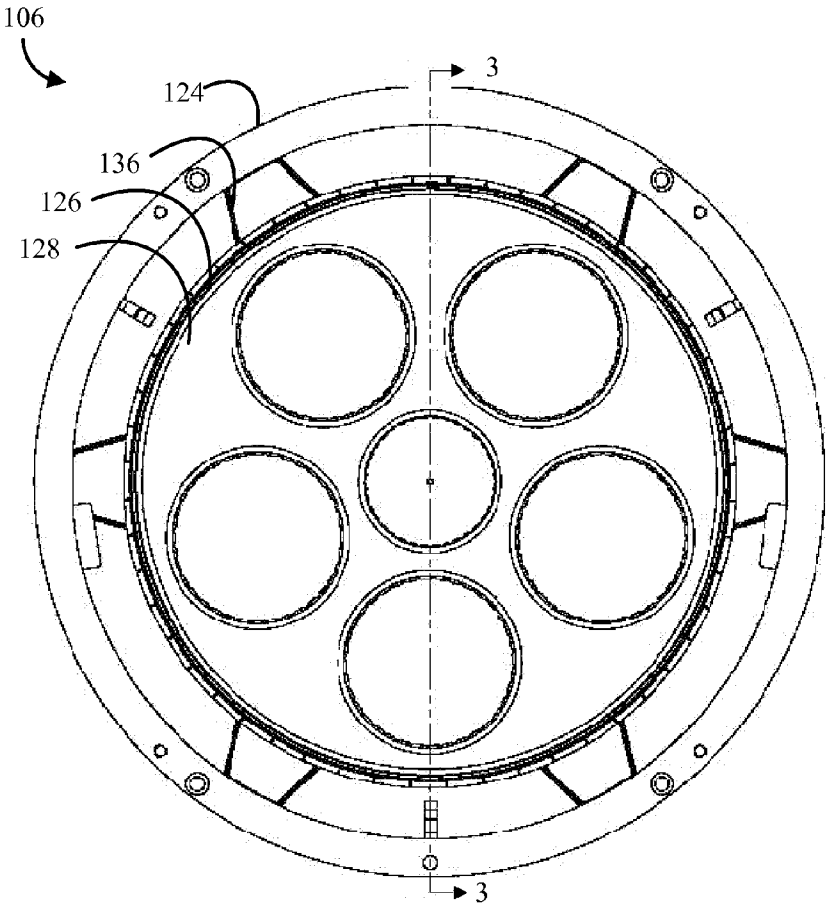
FIG. 2 (PRIOR ART)
FIG. 2 is a plan view of a prior art combustor cap assembly.

An embodiment of a cap assembly 106 is shown in FIGS. 2-3. The cap assembly 106 includes an outer wall 124, an inner wall 126, an end face 128, and in some cases, a forward face 130. The outer wall 124 forms a flange that seats in the aft case 120 to mount the cap assembly 106 to the combustor 100. When so mounted, the outer wall 124 extends forward from the flange toward the forward case 118. The outer wall 124 defines the outer boundary of a portion of the annular passageway 110.

The inner wall 126 of the cap assembly 106 is spaced inward from the outer wall 124 and is supported thereon by a number of brackets 136 extending through the annular passageway 110. The inner wall 126 defines a cap chamber 132, through which the fuel nozzles 114 extend. The inner wall 126 also defines a number of openings 134 that permit diverting air from the annular passageway 110 into the cap chamber 132 for cooling purposes. The diverted air passes through a number of small openings in the end face 128 to convectively cool the end face 128, which encloses the forward end of the combustion chamber 104 and is therefore exposed to high temperatures. An arrow in FIG. 1 illustrates the diverted air entering the cap chamber 132.

In FIG. 1, the lengths of the arrows schematically represent the pressure of the air traveling through the annular passageway 110 and the cap assembly 106. As shown, the air experiences pressure losses as it travels through the annular passageway 110 and the cap assembly 106. In one embodiment, for example, air entering the annular passageway 110 loses about 5 psi as it travels across the impingement sleeve, resulting in a pressure of about 245 psia in the annular passageway 110. Additional losses of about 2 to 3 psi occur as the air travels along the annular passageway 110, enters the cap assembly 106, and turns near the end cover 116. Thus, a pressure drop of about 3 to 6 psi may be all that remains for cooling when the air reaches the cap chamber 132. Because of the system pressure losses, a relatively larger amount of lower pressure air is needed to cool the cap assembly 106.

Described below are embodiments of systems and methods of providing high pressure air to a head end of a combustor. In embodiments, the high pressure air is PCD air from the diffuser. Also in embodiments, the high pressure air is provided to the combustion liner cap assembly. The high pressure air can be provided to the cap assembly to cool the cap assembly or to improve the dynamics barrier. The high pressure air can also be used for other purposes.

In embodiments, the systems and methods provide a direct flow path between a source of PCD air and a head end of the combustor. For example, the systems and method may directly connect the diffuser to the cap assembly. In some embodiments, the direct connection may be a simple pipe that ports PCD air from the diffuser to the cap assembly or other portions of the head end. In other embodiments, the direct connection may be provided by way an additional outer annular passageway in the cap assembly. The outer annular passageway may be at least partially sealed off from an inner annular passageway in the cap assembly. The inner annular passageway receives air from along the length of the combustor, much like a conventional annular passageway, while the outer annular passageway directs high pressure air to the cap assembly. For example, the outer annular passageway may receive high pressure air directly from the diffuser and may port the higher pressure air directly to the cap assembly. Thus, the higher pressure air does not experience the pressure losses associated with impinging against the transition duct and combustion liner and traveling along the length of the combustion chamber toward the cap assembly.

In embodiments, the outer annular passageway is formed between a portion of a pressure vessel about the combustor and a portion of the cap assembly. In particular, the outer annular passageway may be formed between a forward case wall, which extends from the forward case near the end cover to the compressor discharge case adjacent to the diffuser, and an outer cap flow sleeve of the cap assembly, which extends from the forward case to the combustor flow sleeve. The outer annular passageway can communicate air directly from the diffuser to the cap chamber for cooling purposes. Thus, the air experiences less of a pressure loss than air traveling through the inner annular passageway along the combustor.

Figure 4:
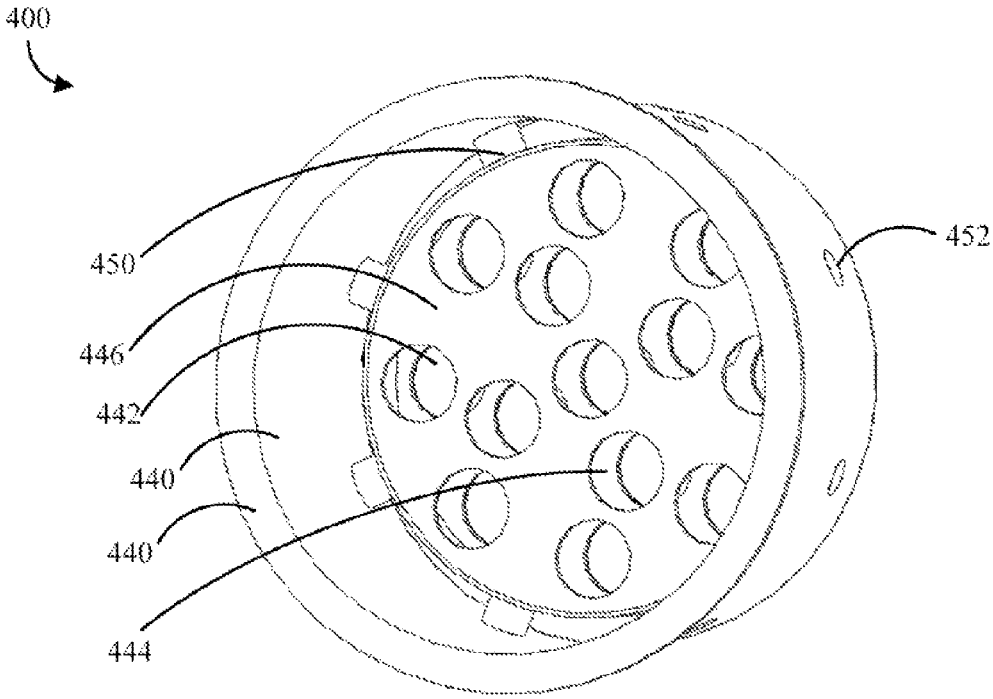
FIG. 4 is a perspective view of an embodiment of a combustion liner cap assembly in accordance with embodiments of the present invention.
Figure 5:
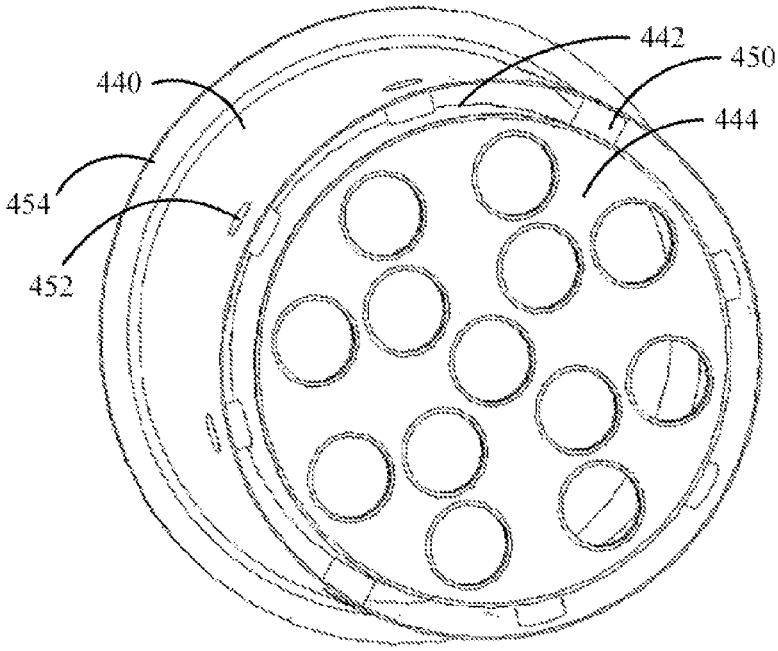
FIG. 5 is a perspective view of portion of the cap assembly shown in FIG. 4, illustrating the cap assembly from another angle.

FIG. 4 is a perspective view of an embodiment of a combustion liner cap assembly 400, and FIG. 5 is a perspective view of a portion of the cap assembly 400 shown in FIG. 4, illustrating the cap assembly 400 from another angle. The combustion liner cap assembly 400 includes an outer wall or outer flow sleeve 440, an inner wall or inner flow sleeve 442, an end face 444, and a forward face 446.

The outer and inner walls 440, 442 are concentrically positioned with reference to each other, with the inner wall 442 spaced inward from the outer wall 440. The space between the outer and inner walls 440, 442 defines an annular gap, while the space on the interior of the inner wall 442 defines an annular boundary of a combustor cap chamber. The end and forward faces 444, 446 are substantially plates, although the end face can be substituted with a end face assembly as described below. It should be noted that the forward face 446 is not shown in FIG. 5 for illustrative purposes.

The inner wall 442 supports the end and forward faces 444, 446, which enclose the combustion cap chamber on forward and rearward sides. The outer wall 440 supports the inner wall 442 via, for example, a number of cross-over tubes 450 mounted in the annular gap. The cross-over tubes 450 place the exterior of the outer wall 440 in communication with the cap chamber. However, the cross-over tubes 450 can be substituted with brackets or other mounting structures in other embodiments.

The outer and inner walls 440, 442 have openings 452 in register with the cross-over tubes 450. In embodiments, the outer and inner walls 440, 442 are substantial continuous or un-perforated at all points other than at the openings 452. The continuous nature of the walls 440, 442 separates or isolates the annular gap from the cap chamber and from the exterior of the outer wall 440. The outer wall 440 may also have a forward flange 454 suited for mounting, for example, to the forward case near the end cover. The end and forward faces 444, 446 have openings for receiving the fuel nozzle assemblies.

Figure 6:
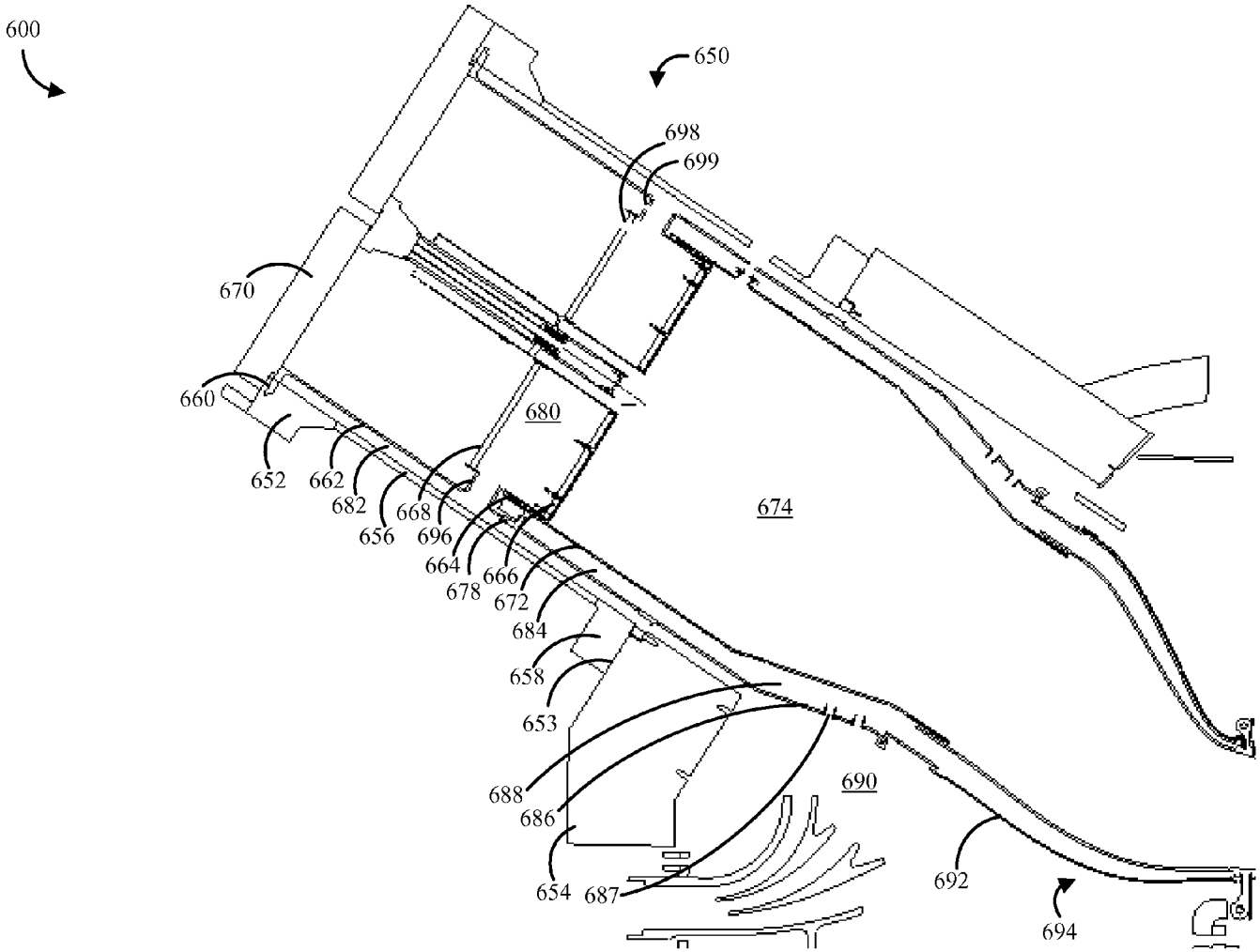
FIG. 6 is a cross-sectional view of an embodiment of a combustor in accordance with embodiments of the present invention.
Figure 7:
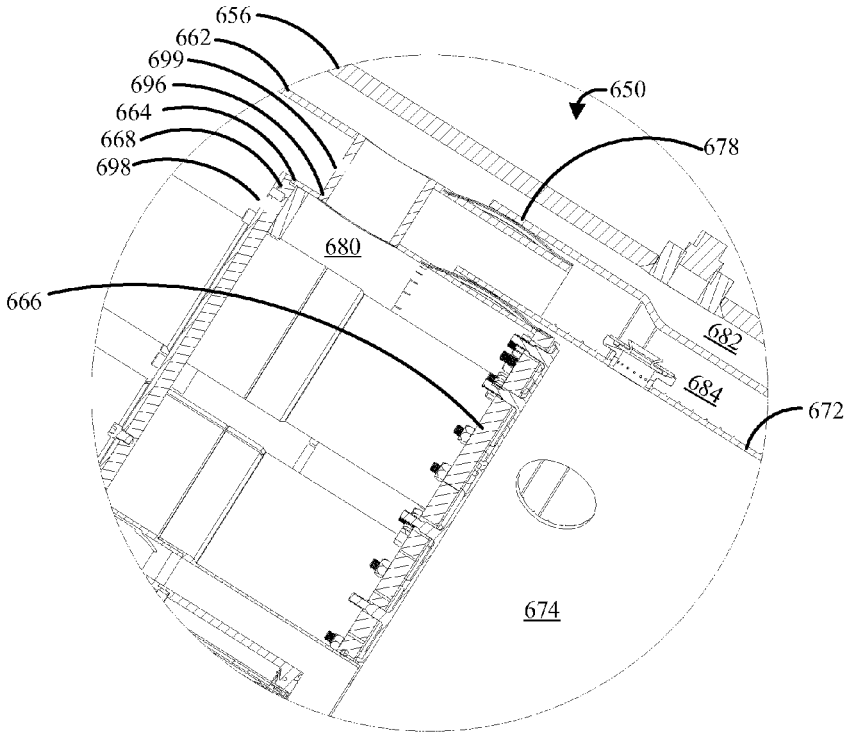
FIG. 7 is a cross-sectional view a portion of the combustor shown in FIG. 6, illustrating a portion of the cap assembly.

FIG. 6 is a cross-sectional view of a combustor 600, illustrating an embodiment of a combustion liner cap assembly 650 mounted to the combustor 600, and FIG. 7 is a cross-sectional view a portion of the combustor 600 illustrating a portion of the cap assembly 650 in further detail. The cap assembly 650 may be an embodiment of the cap assembly shown and described above with reference to FIGS. 4 and 5, although other configurations are possible.

In the combustor 600, the aft case is not present. Instead, the forward case 652 extends to the compressor discharge case 654, and the cap assembly 650 is mounted to the forward case 652. Once so mounted, the cap assembly 650 is wholly enclosed within the forward case 652. However, other configurations are possible.

As shown in FIG. 6, the forward case 652 defines an annular wall 656 that extends from the forward case 652 toward the compressor discharge case 654. The annular wall 656 has a length that spans the distance between the forward case 652 and the compressor discharge case 654. Near the compressor discharge case 654, the annular wall 656 forms an aft flange 658 and connects to the compressor discharge case 654 at an aft flange/CDC interface 653.

Again, the cap assembly 650 includes an outer wall 662, an inner wall 664, an end face 666, and a forward face 668. The cap assembly 650 is mounted to the forward case 652, such as by placing a flange 660 on the outer wall 662 in a corresponding groove near the end cover 670. When so mounted, the end face 666 registers with a circumferential edge of the combustion liner 672 to enclose the combustion chamber 674, and the forward face 668 is positioned between the end face 666 and the end cover 670. The inner wall 664 of the cap assembly 650 aligns with a longitudinal edge of the combustion liner 672 and extends toward the forward case 652, stopping short of the end cover 670. The outer wall 662 is positioned between the inner wall 664 of the cap assembly 650 and the annular wall 656 of the forward case 652. The outer wall 662 has a diameter that exceeds the diameter of the inner wall 664 but is less than the diameter of the annular wall 656, so that an inner annular gap is defined between the inner and outer walls 662, 664, and an outer annular gap is defined between the outer and annular walls 662, 656. The outer wall 662 has a length that extends from the forward case 652 to a flow sleeve 686 about the combustion liner 672. At a connection point 678, the outer wall 662 and the flow sleeve 686 overlap each other and are sealed.

Thus, when the cap assembly 650 is mounted to the combustor 600, the cap assembly 650 is wholly enclosed within the forward case 652. The cap chamber 680 is laterally enclosed by the inner wall 664 and is axially enclosed by the end and forward faces 666, 668. An inner cap annular passageway 684 is formed between the inner wall 664 and the outer wall 662 of the cap assembly 650, while an outer cap annular passageway 682 is formed between the outer wall 662 of the cap assembly 650 and the annular wall 656 of the forward case 652.

The combustor 600 also includes a combustor flow sleeve 686 annularly positioned about the combustion liner 672. The combustor flow sleeve 686 and the combustion liner 672 define a lower combustor annular passageway 688 about the combustion chamber 674. At one end, the lower combustor annular passageway 688 aligns with the inner cap annular passageway 684. At the other end, the lower combustor annular passageway 688 is in communication with the diffuser 690. Particularly, the combustor flow sleeve 686 includes an impingement portion 692 that includes flow sleeve holes 687. The diffuser 690 is positioned in the compressor discharge case 654 adjacent to the impingement portion 692. The diffuser 690 receives PCD air from the compressor and communicates that air into the lower combustor annular passageway 688 through the flow sleeve holes 687 in the impingement portion 692.

Together, the lower combustor annular passageway 688 and the inner cap annular passageway 684 define an inner flow path from the diffuser 690 to the cap assembly 650. The inner flow path extends from the diffuser 690, through the impingement portion 692, along the length of the combustion chamber 674, into the cap assembly 650, through the fuel nozzles and into the combustion chamber 674. Thus, PCD air reaches the cap assembly 650 from the diffuser 690 along an indirect route. Particularly, the PCD air impinges against the transition duct 694 or the combustion liner 672 and travels along the combustion chamber 674 for cooling purposes before entering the cap assembly 650, where the air is mixed in the fuel nozzles and is injected into the combustion chamber 674 for combustion purposes. Due to the indirect route, the PCD air experiences pressure losses before reaching the cap assembly 650.

The outer cap annular passageway 682 defines an outer flow path from the diffuser 690 to the cap assembly 650. The outer cap annular passageway 682 is in direct fluid communication with the diffuser 690 via an opening in the compressor discharge case 654. The outer cap annular passageway 682 is also in direct fluid communication with the cap chamber 680 via the cross-over tubes 696. The outer flow path extends from the diffuser, into the cap assembly 650, through the cross-over tubes 696, and into the cap chamber 680. Thus, PCD air traveling along the outer flow path reaches the cap assembly 650 from the diffuser 690 via a direct route. Due to the direct route, air traveling to the cap assembly 650 along the outer flow path experiences significantly less pressure losses than air traveling along the inner flow path. For example, in cases in which the diffuser 690 provides air at about 250 psia, the air traveling along the outer flow path may reach the cap assembly 650 at about 249 psia, while air traveling along the inner flow path may reach the cap assembly at about 240 to 247 psia.

In embodiments, air traveling along the outer flow path cools portions of the cap assembly 650. For example, the air may enter the cap chamber 680 to cool portions of the cap chamber 680. In some embodiments, the air is used to cool the end face 666. Once the end face 666 is cooled, the air passes into the combustion chamber 674 to participate in the combustion process. The configuration of the end face 666 influences the cooling mode. For example, the end face 666 may be an impingement plate that is cooled via impingement cooling. The end face 666 may also be an effusion plate that is cooled via effusion cooling. The end face 666 may be configured for film cooling, wherein a film of air is formed on a surface of the end face 666 within the combustion chamber 674. Combinations of these cooling modes are also possible. For example, the end face 666 may include impingement and effusion plates separated by a gap. The effusion plate may be exposed to the combustion chamber 674 and may have effusion holes that are angled to form a film of air within the combustion chamber 674. In such an embodiment, the end face 666 may be cooled via a combination of impingement, effusion, and film cooling. The air traveling into the cap assembly 650 may also cool other portions of the cap assembly 650, such as the cross-over tubes 696, the forward face 668, and the outer and inner walls 662, 664.

Because the outer flow path provides relatively higher pressure air to the cap assembly 650 for cooling purposes, the cap assembly 650 is cooled more efficiently. The enhanced cooling improves the durability of the cap assembly 650, increasing its service life. The combustor 600 also can be operated at higher temperatures. Further, less air is needed to cool the cap assembly 650. Thus, a relatively smaller percentage of the air in the combustion chamber 674 is air that passed through the end face 666 for cooling purposes as opposed to air that passed through the end face 666 through the fuel nozzles. Thus, a relatively higher percentage of the air in the combustion chamber 674 is premixed with the fuel, decreasing NOx formation. Further, providing higher pressure air through the end face 666 may improve the dynamics barrier. Particularly, when a dynamic pressure wave occurs in the combustion chamber 674 due to flame instability, the dynamic pressure wave may be relatively less like to impede or stop the passage of cooling air through the end face 666. Due to the higher pressure of the cooling air, the air may continue to pass through the end face 466, averting thermal stress or failure.

It should be noted that the relatively higher pressure air traveling along the outer flow path into the cap assembly 650 can be used for other purposes. The air can be directed to other structures for cooling purposes or for other purposes. In embodiments in which the air is not directed into the cap chamber 680, the cross-over tubes 696 may be substituted with conventional brackets. However, including the cross-over tubes 696 may alleviate manufacturing and repair issues associated with the brackets.

In embodiments, the high pressure air can be used to improve the uniformity of the air flow into the fuel nozzles. For example, the forward face 668 may have air distribution holes 698 that direct air from the cap chamber 680 toward the fuel nozzles. The air distribution holes 698 may be sized and positioned to provide air to underfed fuel nozzles so that the air flow into the fuel nozzles is more uniform. Only one air distribution hole 698 is shown for the purposes of illustration, but any number and position could be used.

In embodiments, the cross-over tubes 696 may have one or more passage holes 699. The passage holes 699 may be formed through a wall of the cross-over tube 696. The passage holes 699 may permit high pressure air to leak from the interior passageway of the cross-over tubes 696, through the passage holes 699, and into the inner cap annular passageway 684. The leaked air may fill a wake region behind the cross-over tube 696, reducing pressure loss and improving flow uniformity.

In embodiments, the outer flow path is at least partially sealed to maintain the pressure of the PCD air. For example, the annular and outer walls 656, 662 can be sealed at the connection points 653, 678 to limit or prevent air loss at the junction to the inner annular passageway 484. The outer and inner walls 662, 664 can be sealed at the cross-over tubes 696 to limit or prevent leakage through the openings in the walls. The outer and inner walls 662, 664 can be substantially continuous or un-perforated to limit or prevent leakage between the outer and inner annular passageways 682, 684. The cap chamber 680 can also be sealed, such as at the interface of the end and forward faces to the inner wall 664, or about the openings that receive the fuel nozzles. Any combination of these seals can be employed to reduce pressure loss of high pressure air in the outer flow path.

It should be noted that the embodiment described above is merely one example of a system for providing high pressure or PCD air to the head end of the combustor. Other embodiments are intended to be included within the scope of the present disclosure. For example, the system can be designed for a combustor having a conventional cap assembly, such as the combustor 100 shown in FIG. 1. In such embodiments, the cap assembly may have cross-over tubes between the inner and outer walls instead of brackets. Further, cap and flow sleeve flanges can have holes that place the cross-over tubes in direct fluid communication with the diffuser. The system may be sealed, such as by sealing the outer wall. The inner wall of the cap assembly may not have the openings that would otherwise divert air into the cap chamber from the annular passageway. In some embodiments, the combustor 100 can be retrofitted with a system for providing high pressure or PCD air to the head end of the combustor.

In still other embodiments, a pipe or conduit may extend from the diffuser to the cap chamber. The pipe may deliver PCD air directly from the diffuser to the cap chamber. In such an embodiment, the inner wall of the cap assembly may be substantially continuous or un-perforated, so that the PCD air does not leak backwards into the annular passageway.

Figure 8:
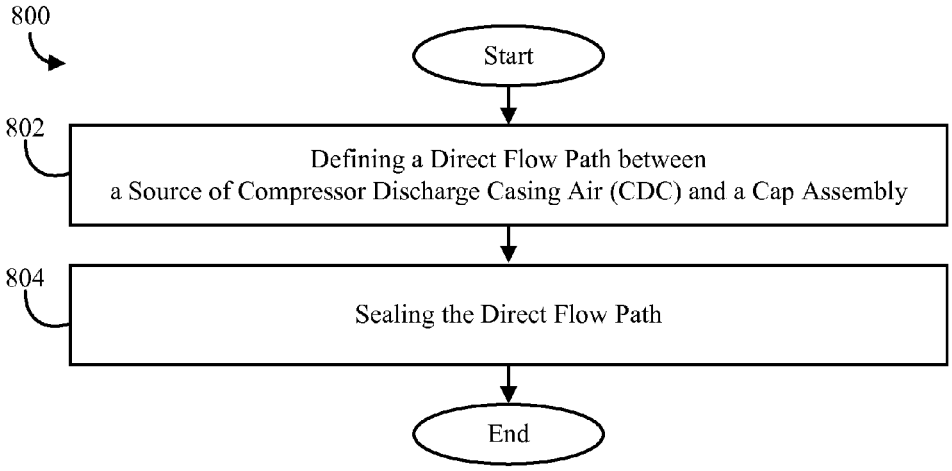
FIG. 8 is a block diagram illustrating an embodiment of a method of cooling a combustor cap assembly.

FIG. 8 is a block diagram illustrating an embodiment of a method 600 of cooling a combustor cap assembly. In block 802, a direct flow path is defined between a source of PCD air and a combustor cap assembly. In block 804, the direct flow path is at least partially sealed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A combustor comprising:

a first flow path comprising a diffuser in indirect fluid communication with a combustor cap assembly by way of an intervening lower combustor annular passageway;

a second flow path comprising the diffuser in direct fluid communication with the combustor cap assembly; and wherein the combustor cap assembly comprises: an outer wall, an inner wall spaced inward from the outer wall to define an inner cap annular passageway, a plurality of cross-over tubes extending between the outer wall and the inner wall to provide a flow path across the inner cap annular passageway, and a plurality of fuel nozzle openings formed through an internal structure surrounded by said internal wall.

2. The combustor of claim 1, wherein the second flow path is at least partially sealed to limit leakage to the first flow path.

3. The combustor of claim 1, wherein the outer and inner walls are substantially continuous and un-perforated, except at openings that are in register with the cross-over tubes.

4. The combustor of claim 1, wherein the inner cap annular passageway connects to the lower combustor annular passageway to define at least a portion of the first flow path.

5. The combustor of claim 4, further comprising an outer cap annular passageway formed between the outer wall and a portion of a casing.

6. The combustor of claim 5, wherein the outer cap annular passageway is in direct fluid communication with an opening from the diffuser.

7. The combustor of claim 5, wherein:

the combustor cap assembly further comprises a cap chamber; and the cross-over tubes place the outer cap annular passageway in fluid communication with the cap chamber.

8. The combustor of claim 1, further comprising:

a compressor discharge case; and a forward case comprising an annular wall.

9. The combustor of claim 8, wherein the combustor cap assembly is mounted to the combustor such that the outer wall of the cap assembly is spaced inward from the annular wall of the forward case to define an outer cap annular passageway.

10. The combustor of claim 9, wherein the outer cap annular passageway is in fluid communication with the diffuser.

11. The combustor of claim 10, wherein:

the combustor cap assembly further comprises a cap chamber; and the cross-over tubes place the outer cap annular passageway in fluid communication with the cap chamber.

12. The combustor of claim 9, wherein the annular wall mounts to the compressor discharge case such that the outer cap annular passageway is in direct fluid communication with the diffuser.

13. A combustor cap assembly comprising:

an outer annular wall;

an inner annular wall spaced inward from the outer annular wall to define an annular gap;

a plurality of cross-over tubes extending between the outer annular wall and the inner annular wall, the cross-over tubes defining flow channels across the annular gap; and a plurality of fuel nozzle openings formed through an internal structure surrounded by said internal wall.

14. The combustor cap assembly of claim 13, wherein the outer annular wall is substantially continuous and un-perforated, except at openings in register with the cross-over tubes.

15. The combustor cap assembly of claim 13, wherein the outer annular wall defines a forward flange suited for mounting the combustor cap assembly to a forward case of a combustor.

16. The combustor cap assembly 13, said internal structure further comprising:

an end face; and a forward face, wherein the faces and the inner wall enclose a cap chamber.

17. The combustor cap assembly of claim 16, further comprising air distribution holes formed through the forward face.

18. The combustor cap assembly of claim 16, wherein the cross-over tubes are in fluid communication with the cap chamber.

19. The combustor cap assembly of claim 13, further comprising at least one passage hole formed through a wall of the cross-over tube, wherein the at least one passage hole places an interior of the cross-over tube in fluid communication with the annular gap.

* * * * *